US009096402B2

(12) United States Patent
Nishimura

(10) Patent No.: US 9,096,402 B2
(45) Date of Patent: Aug. 4, 2015

(54) SHEET MATERIAL SUPPLYING DEVICE

(71) Applicant: TSUDAKOMA KOGYO KABUSHIKI KAISHA, Kanazawa-Shi, Ishikawa-Ken (JP)

(72) Inventor: Isao Nishimura, Kanazawa (JP)

(73) Assignee: TSUDAKOMA KOGYO KABUSHIKI KAISHA, Kanazawa-Shi (JP)

( * ) Notice: Subject to any disclaimer, the term of this patent is extended or adjusted under 35 U.S.C. 154(b) by 171 days.

(21) Appl. No.: 13/937,248

(22) Filed: Jul. 9, 2013

(65) Prior Publication Data

US 2014/0014761 A1 Jan. 16, 2014

(30) Foreign Application Priority Data

Jul. 12, 2012 (JP) ..... 2012-156826

(51) Int. Cl.
*B65H 18/08* (2006.01)
*B65H 23/188* (2006.01)
*B65H 23/182* (2006.01)

(52) U.S. Cl.
CPC ..... *B65H 23/1888* (2013.01); *B65H 23/182* (2013.01)

(58) Field of Classification Search
USPC ..... 242/419.5, 419.7–419.8, 420.5, 615.21, 242/534.1, 563.1
See application file for complete search history.

(56) References Cited

U.S. PATENT DOCUMENTS

| | | | | |
|---|---|---|---|---|
| 3,934,775 | A * | 1/1976 | Keller | 226/23 |
| 4,318,513 | A * | 3/1982 | Martinez | 242/417.3 |
| 4,524,919 | A * | 6/1985 | Wehrmann | 242/533.5 |
| 4,700,905 | A * | 10/1987 | Oppelt et al. | 242/419.8 |
| 4,708,761 | A | 11/1987 | Taniguchi et al. | |
| 5,515,139 | A * | 5/1996 | Hou et al. | 399/38 |
| 6,471,152 | B1 * | 10/2002 | Suzuki et al. | 242/417.3 |
| 6,536,705 | B1 * | 3/2003 | Bock | 242/541.4 |

FOREIGN PATENT DOCUMENTS

| | | |
|---|---|---|
| JP | 62-97834 A | 5/1987 |
| JP | 05-200898 A | 8/1993 |
| JP | 10-87126 A | 4/1998 |

* cited by examiner

*Primary Examiner* — Sang Kim
(74) *Attorney, Agent, or Firm* — Yoshida & Associates, LLC

(57) ABSTRACT

A sheet material supplying device includes a tension detection device that detects tensions at both end portions of the unprocessed sheet material in a widthwise direction of the sheet material; an engaging roller that engages the sheet material at a location that is upstream of the processing section in a path of the sheet material that is drawn out; a supporting mechanism that supports both end portions of the engaging roller and that is displaceably supported with respect to the frame such that an axis of the engaging roller is tiltable in a direction that crosses a sheet surface of the sheet material with which the engaging roller engages; an actuator that is connected to the supporting mechanism and that displaces the supporting mechanism; and a drive control device that controls driving of the actuator on the basis of the tensions detected by the tension detection device.

4 Claims, 7 Drawing Sheets

SHEET MATERIAL SUPPLYING DEVICE

BACKGROUND OF THE INVENTION

1. Field of the Invention

The present invention relates to a sheet material supplying device for drawing out a sheet material from a raw-cloth roll using a drawing-out mechanism to process the sheet material, and for use with a processing device. The raw-cloth roll is one in which a long sheet material is wound into a roll.

2. Description of the Related Art

As such a processing device including a sheet material supplying device, processing devices are disclosed in the following related-art documents, Japanese Unexamined Patent Application Publication No. 10-87126 (PTL 1), Japanese Unexamined Patent Application Publication No. 62-97834 (PTL 2), and Japanese Unexamined Patent Application Publication No. 5-200898 (PTL 3). PTL 1 to PTL 3 are described in detail below.

The processing device that is described in PTL 1 is what is called a slitter take-up device. In the slitter take-up device, a supply web roll (raw-cloth roll) is used. In the supply web roll, a web (sheet material), which is a raw cloth, is wound into a roll. A sheet material supplying device in the slitter take-up device rotatably supports a supply reel at a frame. The supply web roll is provided at the supply reel.

In the slitter take-up device, first, a web is drawn out from the supply web roll, and passes a guide roll, after which slits are formed vertically (in a longitudinal direction of the web) at a plurality of locations in the web in a widthwise direction of the web by a cutting device (processing section). A plurality of webs, which have been formed with narrow widths as a result of forming the slits, are taken up in the form of web rolls by the rotation of take-up reels (a portion of a drawing-out mechanism) that are provided in correspondence with the plurality of webs. The web rolls are provided at outer peripheries of the take-up reels.

The processing device that is described in PTL 2 is a prepreg material lay-up device. The term "prepreg" refers to a sheet material in which fiber, such as carbon fiber or glass fiber, is impregnated with resin, such as epoxy resin. In the lay-up device, a roll (raw-cloth roll) in which the prepreg material (sheet material) and backing sheet are placed upon each other and taken up in the form of a roll is used. In the lay-up device, a plurality of sheet material supplying devices are accommodated in a roll stocker, and a roll in each supplying device is rotatably and movably supported via a shaft.

In addition, in the lay-up device, first, a selected supplying device is moved to a predetermined position in the roll stocker, and the prepreg material is let off while taking up the backing sheet from the roll of the supplying device. In the direction in which the prepreg material is let off, a lay-up table (processing section) extends, and an edge of the let off prepreg material is held by a puller (drawing-out mechanism). Then, as the puller moves, the prepreg material is drawn out by a predetermined length on the lay-up table, and is cut by a cutting device. Thereafter, a contact-bonding head is moved in a longitudinal direction of the prepreg material while pushing the prepreg material against the lay-up table. By repeating these operations, the lay-up device lays up prepreg materials on the lay-up table.

As with the processing device that is described in PTL 2, the processing device that is described in PTL 3 is a prepreg material lay-up device. In the lay-up device, a prepreg raw-cloth roll (raw-cloth roll) in which a prepreg tape (sheet material) and release paper are placed upon each other and taken up in the form of a roll is used. In addition, a sheet material supplying device in the lay-up device rotatably supports an unwinding section at which the prepreg raw-cloth roll is provided.

In addition, in this device, above a lay-up surface material that is placed on a lay-up table, the prepreg tape is drawn out from the prepreg raw-cloth roll while taking up the release paper from the prepreg raw-cloth roll. Then, while the device, itself, reciprocates in a straight line, a lay-up roller (processing section) pushes the drawn out prepreg tape against the lay-up surface material. Then, the lay-up device, itself, reciprocates in a straight line. When the lay-up device (drawing-out mechanism) that is capable of reciprocating in this way repeats these operations, prepreg tapes are laid up on the lay-up surface material.

In such devices that are described in the related-art documents, when a sheet material is drawn out from a raw-cloth roll, the sheet material may be in a state in which a tension difference exists in the sheet material in a widthwise direction thereof. There are various factors that give rise to such a tension difference, one of which being a difference between internal stresses (residual stresses) in the widthwise direction in the sheet material that is wound into a raw-cloth roll. In particular, when the sheet material is a prepreg material that is described in PTL 2 and PTL 3, this tends to occur frequently.

In addition, as mentioned above, when a tension difference exists in the sheet material in the widthwise direction thereof that has been drawn out from the raw-cloth roll, the following problems occur.

In the slitter take-up device that is disclosed in PTL 1, the sheet material may not be properly slitted (cut) at a side where the tension is low, or cut edges of the slitted sheet material may not be aligned.

In the lay-up devices that are disclosed in PTL 2 and PTL 3, the drawn out sheet material may be in a meandering state because the sheet material is not drawn out in a straight line. In laying up prepreg materials, the widthwise-direction position of each prepreg material (sheet material) to be laid up is required to be very highly precise. Therefore, the meandering state becomes a problem in laying up prepreg materials.

SUMMARY OF THE INVENTION

Accordingly, in view of the aforementioned actual condition, it is an object of the present invention to make it possible to, in a sheet material supplying device that supplies a sheet material by drawing out the sheet material from a raw-cloth roll, correct a tension difference in the drawn out sheet material in a widthwise direction thereof and properly supply the sheet material so as not to allow problems to occur when processing the sheet material.

The present invention presupposes a sheet material supplying device for drawing out a long sheet material from a raw-cloth roll, formed by winding the sheet material into a roll, by a drawing-out mechanism, and for use with a processing device that processes the sheet material at a processing section, the sheet material supplying device rotatably supporting the raw-cloth roll with respect to a frame.

The sheet material supplying device according to the present invention includes a tension detection device that detects tensions at both end portions of the unprocessed sheet material in a widthwise direction of the sheet material; an engaging roller that engages the sheet material at a location that is upstream of the processing section in a path of the sheet material that is drawn out; a supporting mechanism that supports both end portions of the engaging roller and that is displaceably supported with respect to the frame such that an axis of the engaging roller is tiltable in a direction that crosses a sheet surface of the sheet material with which the engaging roller engages; an actuator that is connected to the supporting mechanism and that displaces the supporting mechanism; and a drive control device that controls driving of the actuator on the basis of the tensions detected by the tension detection device. Some of the aforementioned terms are described in detail below.

The term "processing" in the present invention not only refers to processing a sheet material that involves a large change in, for example, the shape and properties of the sheet material. The term "processing" also refers to, as in the aforementioned related-art documents, for example, dividing the sheet material into a plurality of sheet materials having narrow widths by vertically forming a slit in the sheet material; and placing a sheet material onto another sheet material and forming this as a portion of a laid-up body including a plurality of sheet materials.

In addition, the terms "upstream side" and "downstream side" are defined in the direction in which the sheet material is drawn out, with the "upstream side" being the side of the raw-cloth roll and the "downstream side" being the opposite side.

Further, the phrase "engaging roller that engages a sheet material" not only refers to direct engagement of the engaging roller with the sheet material that has been drawn out, but also refers to indirect engagement of the engaging roller with the sheet material of the raw-cloth roll. That is, in an embodiment below, the engaging roller is a support shaft (let-off shaft) that supports a winding shaft (winding core) of the raw-cloth roll. The support shaft engages the sheet material in the raw-cloth roll via the winding shaft. This case is also included in the phrase "engaging roller that engages a sheet material".

As regards the phrase "tiltable in a direction that crosses the sheet surface", for example, for an engaging roller whose axis is parallel to the sheet surface in an initial state, even if the engaging roller is tilted (rotated) in a plane (virtual plane) that is parallel to the sheet surface, the intended effect (change in path length) according to this application cannot be obtained. Therefore, the tilting direction of the engaging roller corresponds to "a direction that crosses the sheet surface".

The term "tiltable" here does not mean that the sheet surface and the axis of the engaging roller are set to a state in which they cross each other by the tilting of the engaging roller. The term "tiltable" means that, when a certain (unspecified) point in time is considered, the engaging roller is supported in a state in which the engaging roller is tiltable in a direction in which the axis of the engaging roller crosses the sheet surface at the certain point in time.

The sheet material supplying device according to the present invention may further include a guide roller that guides the sheet material so as to change a direction of the path for guiding the sheet material that has been drawn out from the raw-cloth roll towards the processing section, and the engaging roller may engage the sheet material at a location that is upstream of the guide roller.

In the sheet material supplying device according to present invention, the engaging roller may be a support shaft that supports the raw-cloth roll with respect to the frame.

In the sheet material supplying device, the supporting mechanism may include a support base that supports both of the end portions of the support shaft and that is supported with respect to the frame so as to be rotatable around a rotation axis extending in a direction that is orthogonal to the axis of the support shaft, the actuator may be a rotary electric motor that is connected to the support base for rotationally driving the support base around the rotation axis, and the drive control device may control a rotation amount of the electric motor on the basis of a difference between the tensions at both of the end portions of the sheet material in the widthwise direction thereof, the tension difference being detected by the tension detection device.

According to the present invention, when, in the sheet material that has been drawn out from the raw-cloth roll, the aforementioned tension difference exists in the widthwise direction thereof, the tensions at both end portions of the sheet material in the widthwise direction thereof are detected by the tension detection device. Then, on the basis of this, the engaging roller that engages the sheet material is tilted so as to be in a state in which its axis crosses the sheet surface at that point in time. As a result, the path length of the sheet material in the widthwise direction thereof changes, so that the tension difference is either reduced or eliminated.

When the engaging roller that engages the sheet material is tilted to change the path length of the sheet material in the widthwise direction thereof as mentioned above, by setting the engagement position of the engaging roller with the sheet material upstream of the guide roller (that is, at the side of the raw-cloth roll or at the side opposite to the processing section), even if the tilting of the engaging roller is changed, the state of the sheet material from the guide roller to the processing section is maintained in a certain state. Therefore, the tilting of the sheet material as the engaging roller tilts does not affect the processing operation by the processing section.

Further, when the support shaft that supports the raw-cloth roll is the engaging roller, it is possible to eliminate the influence of the tilting of the engaging roller on the sheet material.

For example, if a roller upon which a sheet material is wound and which guides the sheet material is the engaging roller, when the roller (engaging roller) is tilted in order to change the path length in the widthwise direction of the sheet material as mentioned above, the sheet material may slide on the engaging roller due to the tilting direction and the properties of the sheet material and the properties of the material of the surface of the engaging roller. When such a sliding occurs, the sheet material is displaced in the path in the widthwise direction thereof. This may adversely affect the processing operation at the processing section.

In contrast, if the raw-cloth roll, itself, is tilted by tilting the support shaft that supports the raw-cloth roll, the aforementioned sliding does not occur between the support shaft and the raw-cloth roll, so that it is possible to eliminate the influence of the sliding.

In addition, from the viewpoint of making it possible to eliminate the influence of the tilting of the engaging roller on the sheet material as mentioned above, it is very effective to form the aforementioned engaging roller as a support shaft, and to form the supporting mechanism that supports the engaging roller as a support base that supports the support shaft and that is supported by the frame so as to be rotatable around a rotation axis extending in a direction that is orthogonal to the axis of the support shaft.

DESCRIPTION OF THE PREFERRED EMBODIMENTS

Figure 1:
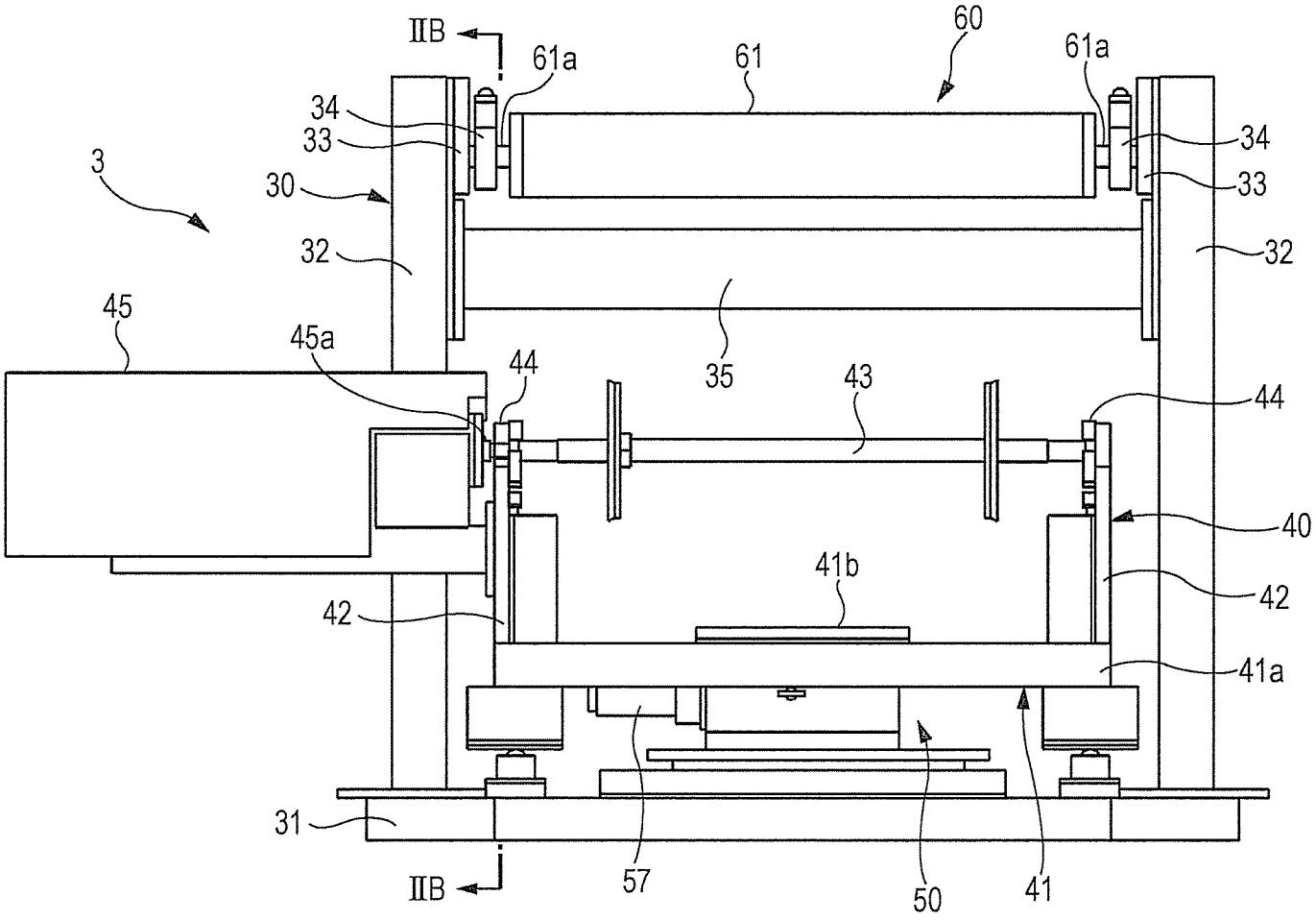
FIG. 1 is a front view of an exemplary supplying device according to the present invention.
Figure 2B:
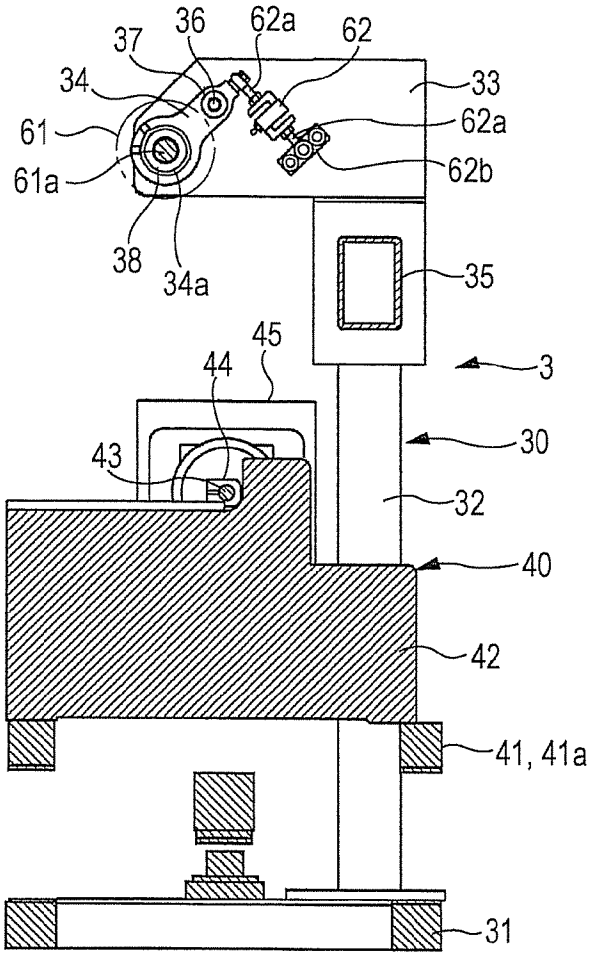
FIGS. 2A and 2B are each a sectional view taken along line IIB-IIB on the right side in FIG. 1.
Figure 2A:
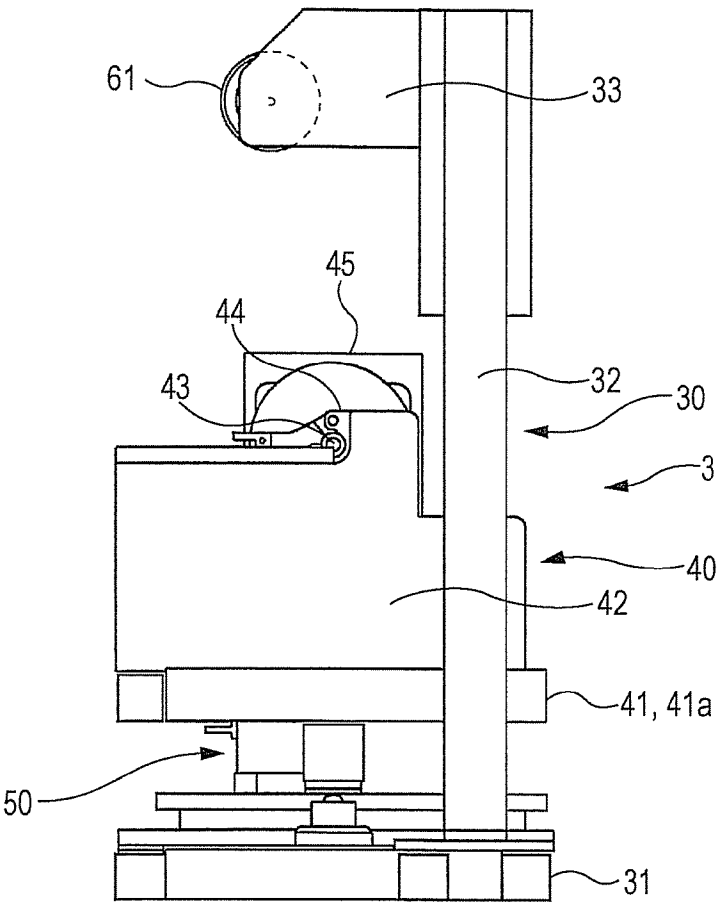
Figure 3:
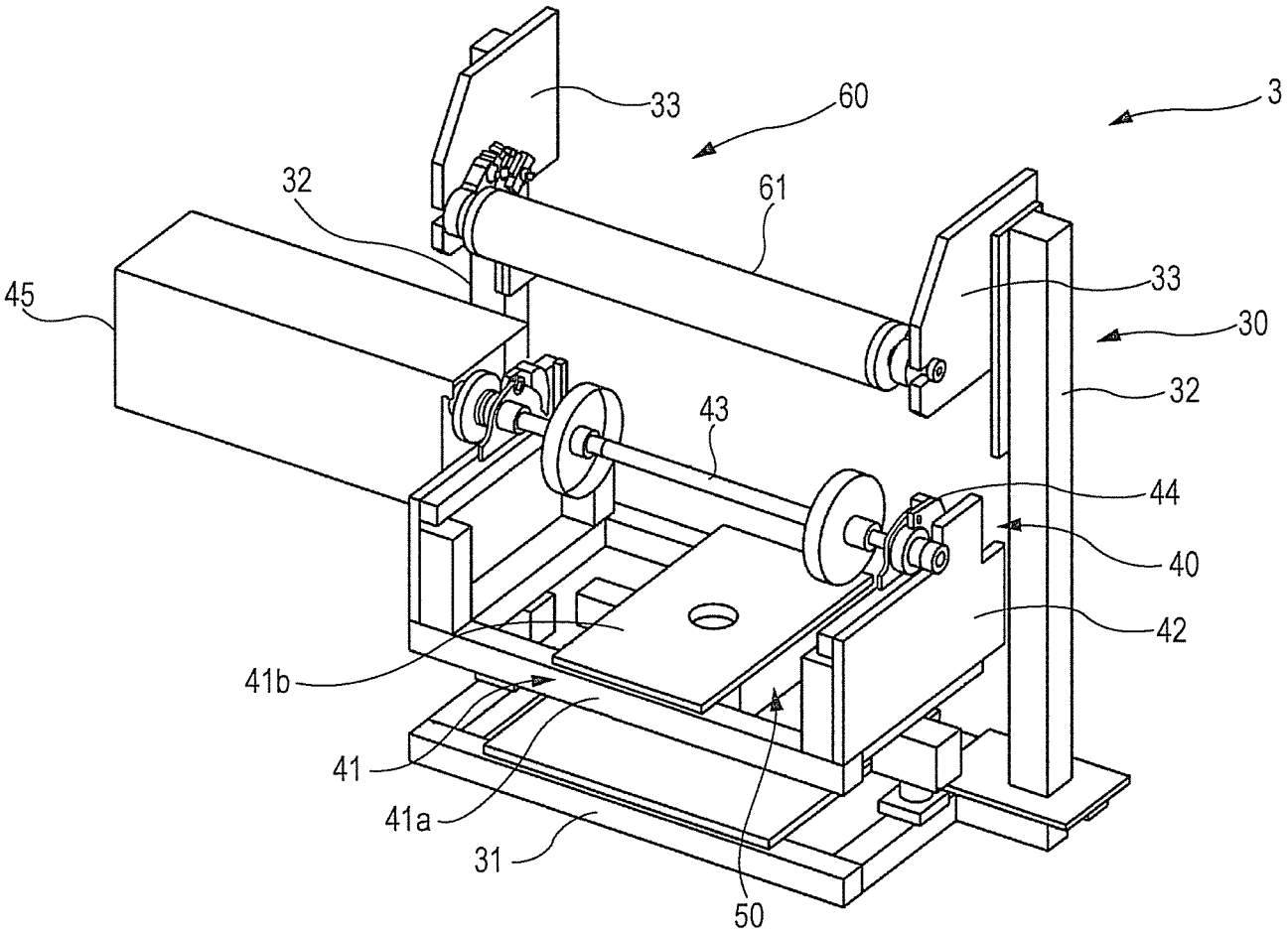
FIG. 3 is a perspective view of main portions of a structure of the exemplary supplying device according to the present invention.
Figure 4A:
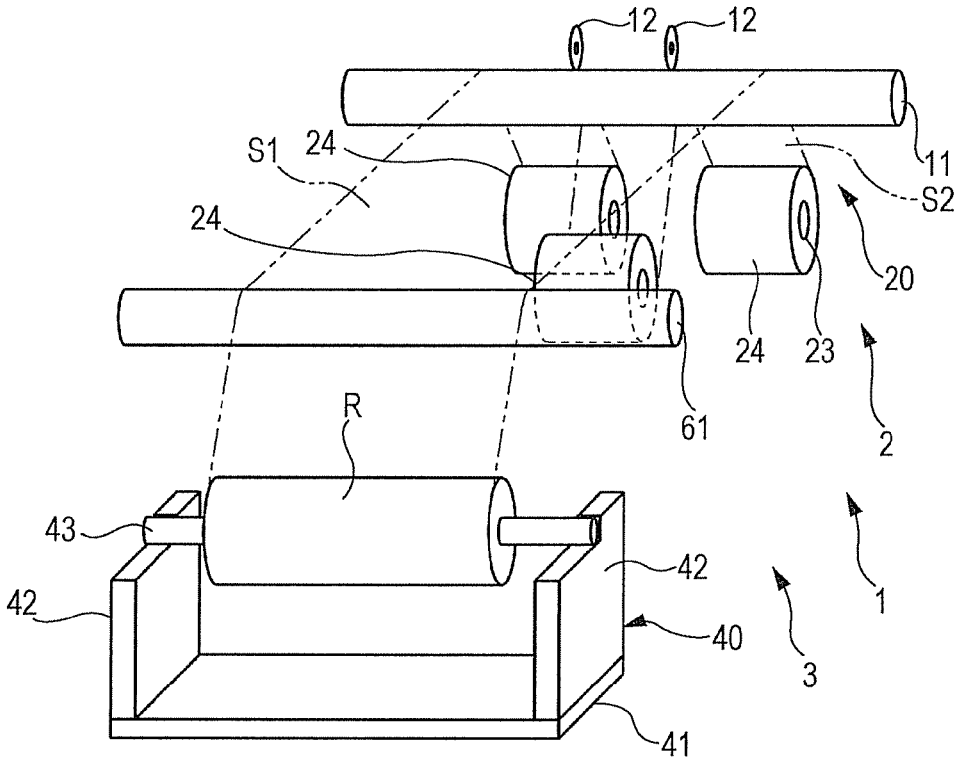
FIGS. 4A and 4B are, respectively, a perspective view and a side view schematically showing an entire structure of an exemplary processing device.
Figure 4B:
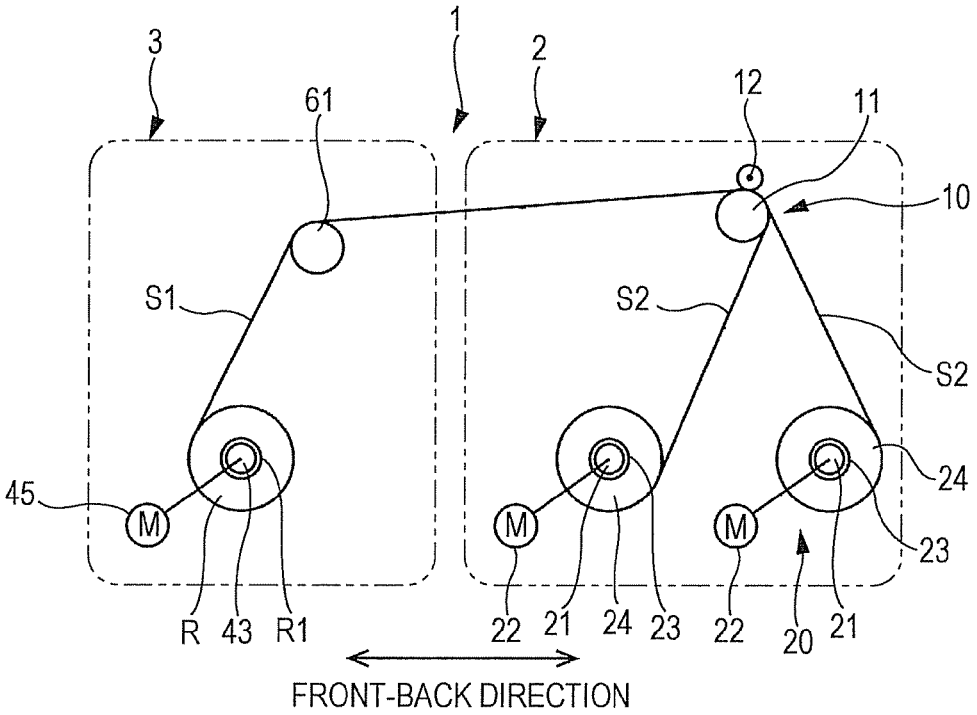

FIG. 1 is a front view of an exemplary supplying device according to the present invention. FIGS. 2A and 2B are each a sectional view taken along line IIB-IIB on the right side in FIG. 1. FIG. 3 is a perspective view for making it easier to understand the relationship between the positions of main portions of a structure of the supplying device according to the present invention. Therefore, strictly speaking, FIG. 1 does not correspond to FIGS. 2A and 2B. FIGS. 4A and 4B are, respectively, a perspective view and a side view schematically showing an entire structure of a processing device to which the supplying device according to the present invention is applied. While primarily using these figures, a supplying device according to an embodiment of the present invention and a processing device to which the supplying device is applied are hereunder described.

In the embodiment, as shown in FIGS. 4A and 4B, as what is called the "processing device" in the present invention, a slitter device 1 (what is called a "slitter take-up device" in the related art section) is used; and a sheet supplying section 3 in the slitter device 1 corresponds to a "supplying device" according to the present invention. Therefore, forming slits in (cutting) a sheet material S1 in a vertical direction (longitudinal direction) and taking up each divided sheet material S2 correspond to "processing a sheet material" in the present invention. The term "sheet material" in the present invention corresponds to a long prepreg material (prepreg sheet) S1 in the embodiment. Therefore, a prepreg roll R in which the prepreg sheet S1 is wound upon a winding shaft R1 in the form of a roll corresponds to a "raw-cloth roll" in the present invention. In the description below, these things are assumed.

As mentioned above, the slitter device 1 is schematically shown in FIGS. 4A and 4B. The slitter device 1 includes the sheet supplying section 3 and a sheet processing section 2. The sheet supplying section 3 supports the prepreg roll R, and allows the prepreg sheet S1 to be drawn out from the prepreg roll R. The sheet processing section 2 processes the prepreg sheet S1 that has been drawn out from the sheet supplying section 3 and performs the aforementioned processing. The sheet processing section 2 corresponds to a "processing section" in the present invention.

The sheet processing section 2 includes a slit section 10 and a take-up section 20. The slit section 10 vertically forms slits in and divides predetermined widthwise-direction locations of the prepreg sheet S1 (hereunder may also be called a "raw-cloth sheet") that has been drawn out from the prepreg roll R. The take-up section 20 separately takes up the divided prepreg sheets S2. However, in the embodiment, it is assumed that the raw-cloth sheet S1 is divided in three in the widthwise direction, and three prepreg rolls 24, 24, and 24 in which the divided prepreg sheets S2 (hereunder may also be called "divided sheets") are wound into rolls are formed.

The slit section 10 includes a cutter roller 11 and a plurality of disc cutters (score cutters) 12 that are provided in accordance with the number of sheet divisions. The cutter roller 11 serves as a base for a cutting operation. In the illustrated embodiment, two disc cutters 12 are provided, and the number of sheet divisions is three.

The prepreg sheet S1 is placed upon the cutter roller 11, and prepreg sheets S2 have their transport direction changed and are transported towards the take-up section 20 that is disposed below the cutter roller 11.

Although, in FIGS. 4A and 4B, a supporting structure of the score cutters 12 is not shown, the score cutters 12 are assumed as being rotatably supported by a beam via cutter holders. The beam is installed between the left and right sides of a frame in the sheet processing section 2. Each cutter holder includes a pressing mechanism. When the pressing mechanisms urge the corresponding cutter holders towards the cutter roller 11, the score cutters 12 are pressed against the cutter roller 11. This causes the score cutters 12 to be rotatably supported by the cutter holders. Therefore, as the prepreg sheet S1 moves forward, the score cutters 12 undergo passive rotation (driven rotation). Consequently, the score cutters 12 vertically cut the prepreg sheet S1, to form divided sheets S2.

The take-up section 20 that takes up the divided sheets S2 that have been cut in this way include a plurality of take-up shafts 21, a plurality of take-up driving motors (take-up motors) 22, and a plurality of take-up reels 23. The plurality of take-up shafts 21 are rotatably supported between portions of the frame. The plurality of take-up driving motors 22 are connected to the corresponding take-up shafts 21 in order to rotationally drive the take-up shafts 21. The plurality of take-up reels 23 are provided in accordance with the number of sheet divisions, and are supported by the corresponding take-up shafts 21 so that they are incapable of rotating relative to the corresponding take-up shafts 21.

The take-up shafts 21 (two take-up shafts 21 in the illustrated embodiment) are displaced from each other in a front-back direction (that is, a direction in which the prepreg sheet S1 moves forward from the sheet supplying section 3 to the cutter roller 11). That is, in the slitter device 1 according to the embodiment, when the plurality of divided sheets S2 are being taken up, adjacent divided sheets S2 are taken up by different take-up shafts 21 (take-up reels 23). Therefore, a plurality of take-up shafts 21 are provided. In the illustrated embodiment, among the three divided sheets S2, the divided sheets S2 that are positioned at the corresponding sides are taken up by the same take-up shaft 21, and the middle divided sheet S2 is taken up by the other take-up shaft 21.

The take-up motors 22 are connected, each to one end of its corresponding take-up shaft 21 via, for example, a speed reducer (not shown). That is, in the take-up section 20, the take-up reels 23 are rotated by rotationally driving the take-up shafts 21 by the corresponding take-up motors 22, so that the divided sheets S2 are taken up while being pulled. Therefore, the take-up section 20 corresponds to a "drawing-out mechanism" in the processing device in the present invention.

Although not described in detail, driving torque of each take-up motor 22 is controlled on the basis of the winding diameter of each divided sheet S2 that is wound upon the corresponding take-up reel 23 and the tension (take-up tension) of each divided sheet S2 that is detected during take-up. This causes each divided sheet S2 to be taken up by its corresponding take-up reel 23 with a certain tension in the take-up section 20.

The details of the sheet supplying section 3 serving as a supplying device according to the present invention that supplies the sheet material S1 to the sheet processing section 2 that is described above are as follows. However, in the description below, FIGS. 1 to 3 and FIGS. 5A and 5B should be referred to instead of FIGS. 4A and 4B.

The sheet supplying section 3 serving as a supplying device primarily includes a frame 30, a support base 40, a rotary drive mechanism 50, and a guide roller 61. The support base 40 supports the prepreg roll R serving as a raw-cloth roll. The rotary drive mechanism 50 is provided for rotatably supporting the support base 40 at the frame 30 and for rotationally driving the support base 40. The prepreg sheet S1 that has been drawn out from the prepreg roll R is placed upon the guide roller 61, and the guide roller 61 guides the prepreg sheet S so as to change a transport direction thereof and transport the prepreg sheet S1 towards the sheet processing section 2.

The frame 30 includes a base 31 and a pair of columns 32 and 32. The base 31 is provided for supporting the entire sheet supplying section 3. The pair of columns 32 and 32 are provided in a standing manner at corresponding sides of the base 31 in a widthwise direction (direction of an axis of the prepreg roll R that is supported).

Plate-shaped support brackets 33 are secured to upper ends of the corresponding columns 32. The guide roller 61 is provided between the opposing support brackets 33 and 33. Therefore, the guide roller 61 is supported between the pair of columns 32 and 32 with the support brackets 33 being disposed between the guide roller 61 and the columns 32 and 32. A beam member 35 is provided between the pair of columns 32 and 32 below the support brackets 33.

The support base 40 is rotatably supported at the base 31 of the frame 30 below the beam member 35 via the rotary drive mechanism 50 (details thereof are given below). The support base 40 includes a base portion 41 and a pair of support walls 42 and 42. The base portion 41 is supported by the frame 30. The pair of support walls 42 and 42 are provided in a standing manner at corresponding sides of the base portion 41 in the widthwise direction. In the illustrated embodiment, the base portion 41 is substantially rectangular in plan view.

In the support base 40, a let-off shaft 43, serving as a support shaft, for supporting the prepreg roll R is provided between the pair of support walls 42 and 42. More specifically, engagement mechanisms 44 that rotatably engage corresponding end portions of the let-off shaft 43 so that they are incapable of being displaced are provided, each at an upper end of its corresponding support wall 42. When the end portions of the let-off shaft 43 are engaged by their corresponding engagement mechanisms 44, the let-off shaft 43 is rotatably provided between the pair of support walls 42 and 42 while the end portions of the let-off shaft 43 are supported by the corresponding support walls 42 and 42. The let-off shaft 43 is provided parallel to the top surface of the base portion 41 of the support base 40 in a vertical direction, and parallel to the guide roller 61 in an up-down direction and a front-back direction. The let-off shaft 43 supports the prepreg roll R in such a manner that the prepreg roll R is incapable of rotating relative to the let-off shaft 43.

A let-off driving motor (let-off motor) 45 for rotationally driving the let-off shaft 43 is supported so as to be mounted to an outer surface of one of the pair of support walls 42 and 42. While an output shaft 45*a* of the let-off motor 45 is oriented parallel to the widthwise direction, the let-off motor 45 is supported by one of the support walls 42, and the output shaft 45*a* is connected to one end of the let-off shaft 43.

Although not described in detail, the let-off motor 45 rotationally drives the let-off shaft 43 for actively letting off the prepreg sheet S1 from the prepreg roll R. The rotation speed of the let-off motor 45 is controlled on the basis of the winding diameter of the prepreg roll R so that the prepreg sheet S1 is let off at a certain speed.

At a location that is downstream from the prepreg roll R, the guide roller 61 guides the prepreg sheet S1 that has been drawn out from the prepreg roll R as mentioned above, and functions as a portion of a tension detection device 60 for detecting the tensions at both end portions of the prepreg sheet S1 in the widthwise direction thereof. The guide roller 61 is described in more detail below.

As described above, the guide roller 61 is supported via the support brackets 33 and 33 so as to be disposed between the support brackets 33 and 33 that are secured to the corresponding columns 32 and 32 at the frame 30. The guide roller 61 is supported by the support brackets 33 with tension detection levers 34 being disposed between the guide roller 61 and the support brackets 33. This is described in more detail below.

The tension detection levers 34 are supported at inner surfaces of the corresponding support brackets 33. Intermediate portions of the corresponding tension detection levers 34 in the direction of extension thereof are rotatably supported by the corresponding support brackets 33 via corresponding shafts 36 and corresponding bearings 37.

A through hole 34*a*, which is formed through its corresponding tension detection lever 34 in a thickness direction (that is, in the direction of an axis of the corresponding shaft 36), is formed in an end of the corresponding tension detection lever 34 in the direction of extension thereof. An outer ring of its corresponding bearing 38 is fitted into its corresponding through hole 34*a*, and shaft portions 61*a* that protrude from corresponding end portions of the guide roller 61 are fitted into inner rings of the corresponding bearings 38, so that the guide roller 61 is supported at the support brackets 33 with the tension detection levers 34 being disposed between the guide roller 61 and the support brackets 33.

A load cell 62, serving as a tension detector, is connected to the other end of its corresponding tension detection lever 34 in the direction of extension thereof. In the illustrated embodiment, each load cell 62 is an S-shaped load cell. Each load cell 62 is such that one of shafts 62*a*, which are mounted to corresponding ends thereof, is connected to the corresponding tension detection lever 34 with, for example, a spherical bearing being disposed therebetween, and the other shaft 62*a* is secured to an inner surface of the support bracket 33 with, for example, a spherical bearing 62*b* being disposed therebetween. In this way, each tension detection lever 34 that is rotatably supported by its corresponding support shaft 33 has its rotational force supported by its corresponding load cell 62. The end portions of the guide roller 61 are connected to the load cells 62 via the tension detection levers 34, and are supported at predetermined positions.

By virtue of this structure, the tension of the prepreg sheet S1 that is placed upon the guide roller 61 acts upon the guide roller 61, and a load that acts upon the guide roller 61 is detected by each of the load cells 62. When a tension difference exists in the prepreg sheet S1 in the widthwise direction, the detection values of the corresponding load cells 62 differ from each other in proportion to the tension difference.

Figure 5A:
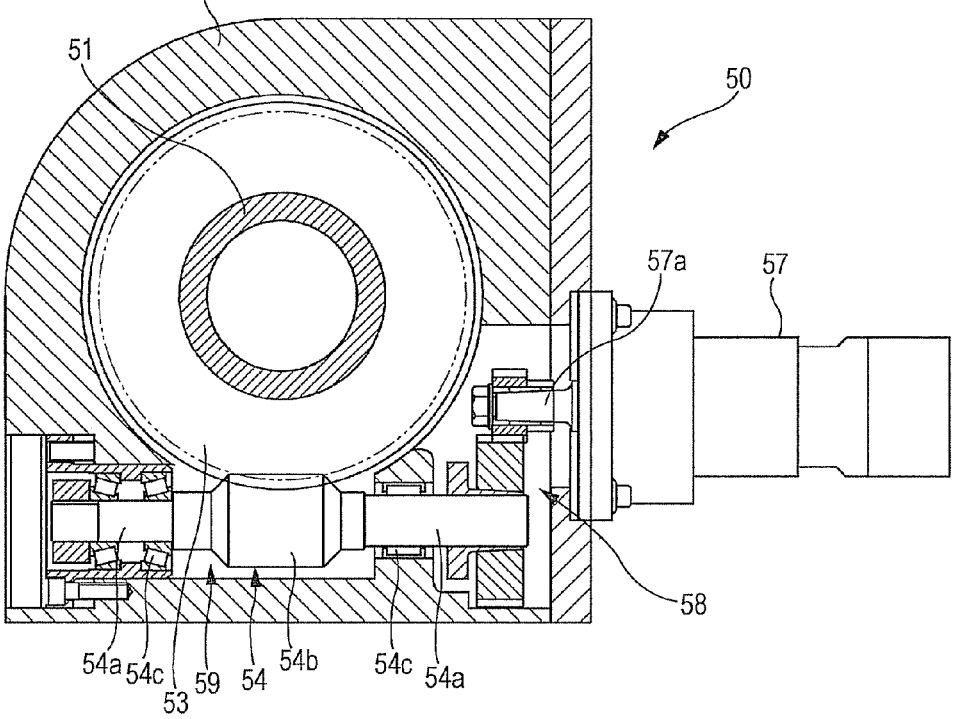
FIG. 5A is a plan view showing most of a rotary drive mechanism of the supplying device in cross section.
Figure 5B:
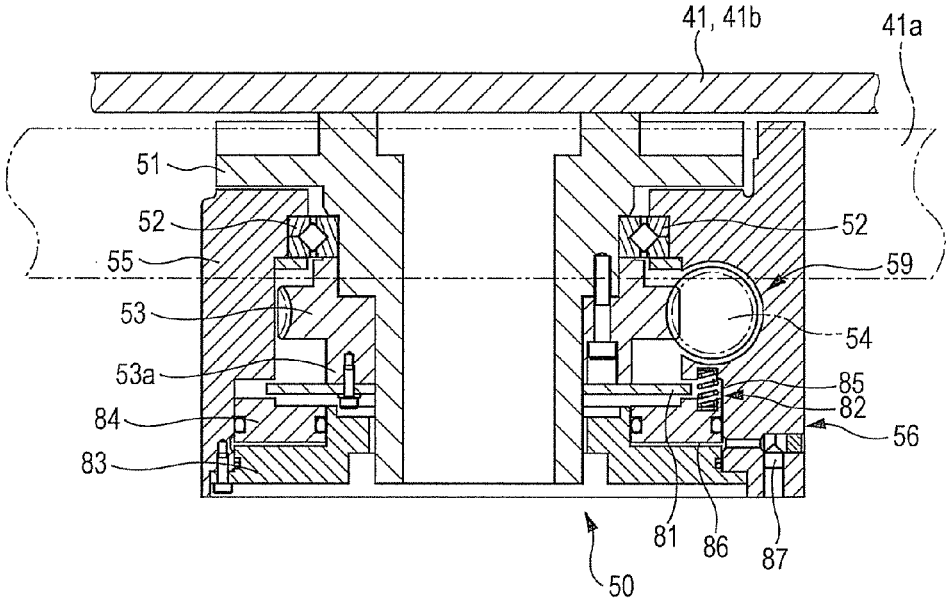
FIG. 5B is a sectional front view of the rotary drive mechanism.

FIGS. 5A and 5B show in detail the aforementioned rotary drive mechanism 50 that rotatably supports the support base 40. The rotary drive mechanism 50 includes a housing 55, a rotating shaft 51, a bearing 52, a rotation amount adjusting mechanism 59, and a clamping mechanism 56. The housing 55 is secured to the base 31 of the frame 30. The rotating shaft 51 is rotatably supported by the housing 55 in the interior of the housing 55. The bearing 52 is provided between the housing 55 and the rotating shaft 51 for rotatably supporting the rotating shaft 51 by the housing 55. The rotation amount adjusting mechanism 59 is provided for rotationally driving the rotating shaft 51 by a predetermined amount (arbitrary angle). The clamping mechanism 56 is provided for holding the rotating shaft 51 that has been rotated by the predetermined amount.

In the illustrated embodiment, the rotation amount adjusting mechanism 59 is a worm gear mechanism, and includes a worm wheel 53 and a worm 54. The worm wheel 53 is secured to the rotating shaft 51 in such a manner as to be incapable of rotating with respect to the rotating shaft 51. The worm 54 engages the worm wheel 53.

A boss 53*a* of the worm wheel 53 has a through hole. With the rotating shaft 51 being fitted into the through hole, the worm wheel 53 is mounted to an intermediate portion of the rotating shaft 51 in such a manner that, at the boss 53*a*, the worm wheel 53 is incapable of rotating relative to the intermediate portion of the rotating shaft 51. A shaft portion 54*a* of the worm 54 is rotatably supported by the housing 55 via the bearing 54*c*. The shaft portion 54*a* extends in the direction of an axis of the worm 54. A worm portion 54*b* of the worm 54 engages the worm wheel 53, and the shaft portion 54*a* is connected to an output shaft 57*a* of a rotary electric motor (driving motor) 57, serving as an actuator, via a gear train 58. The worm portion 54*b* is formed continuously with the shaft portion 54*a*. The driving motor 57 is mounted to a side surface of the housing 55.

In the illustrated embodiment, the clamping mechanism 56 is a disc-clamp type clamping mechanism. The clamping mechanism 56 includes a ring-shaped clamp disc 81 and a pressing mechanism 82. The clamp disc 81 is mounted to the rotating shaft 51 in such a manner as to be incapable of rotating relative to the rotating shaft 51. In cooperation with the housing 55, the pressing mechanism 82 clamps the clamp disc 81 and causes a braking force to act upon the clamp disc 81. The pressing mechanism 82 includes a ring-shaped piston member 84, a securing member 83, and compression springs 85. The piston member 84 causes a pressing force to act upon the clamp disc 81. The securing member 83 is secured to the housing 55, and guides the movement of the piston member 84 in an axial direction of the rotating shaft 51. The compression springs 85 urge the piston member 84 towards a side opposite to the side where the clamp disc is provided. In the illustrated embodiment, the securing member 83 serves as a cover of the housing 55 at one side of the rotating shaft 51 in the axial direction thereof.

More specifically, the pressing mechanism 82 is such that the piston member 84 is fitted into a ring-shaped space (formed between the securing member 83 and the housing 55) so as to oppose the clamp disc 81 in a direction parallel to the axial direction of the rotating shaft 51, and is movable along the axial direction of the rotating shaft 51. The compression springs 85 are disposed in a space between the piston member 84 and the housing 55 in a circumferential direction. The compression springs 85 cause urging force to act upon the piston member 84 towards the side opposite to the side where the clamp disc is provided. Therefore, the piston member 84 is normally urged by the urging force of the compression springs 85 towards the securing member 83 (that is, towards the side opposite to the side where the clamp disc is provided). Pressure fluid (such as pressure oil) is supplied from a fluid supply channel 87 (formed in the housing 55) to a ring-shaped space 86 (formed between the securing member 83 and the piston member 84).

In the clamping mechanism 56, in this operating mode, when the pressure fluid is supplied from the fluid supply channel 87 and the pressure of the pressure fluid in the space 86 is increased, the piston member 84 opposes the urging force of the compression springs 85, so that the piston member 84 is displaced towards the clamp disc 81 and causes pressing force to act upon the clamp disc 81. As a result, the clamp disc 81 is clamped by the piston member 84 and the housing 55, so that the rotating shaft 51, to which the clamp disc 81 is mounted so as to be incapable of rotating relative to the rotating shaft 51, is held in such a manner as to be incapable of rotation.

In the embodiment, the support base 40 is supported by the frame 30 via such a rotary drive mechanism 50. More specifically, the support base 40 is secured to an upper end of the rotating shaft 51 (other end of the rotating shaft 51 in the axial direction thereof) of the rotary drive mechanism 50. Even more specifically, as shown in FIGS. 1, 3, and 5A and 5B, the base portion 41 of the support base 40 is formed by combining beam materials 41*a* in a rectangular shape. A plate-shaped support plate 41*b* is secured to a top surface of the front beam material 41*a* and a top surface of the back beam material 41*a* so as to bridge these beam materials 41*a* and 41*a*. By securing the back surface of the support plate 41*b* to a top end of the rotating shaft 51 of the rotary drive mechanism 50, the support base 40 is secured to the rotating shaft 51.

As mentioned above, the rotating shaft 51, to which the support base 40 is secured, is rotatably supported by the housing 55 of the rotary drive mechanism 50 (which is placed upon and secured to the base 31 of the frame 30) with the bearing 52 being disposed therebetween. Therefore, by virtue of this structure, the support base 40 is rotatably supported by the base 31 of the frame 30 via the rotating shaft 51, the bearing 52, and the housing 55 of the rotary drive mechanism 50.

In the rotary drive mechanism 50, while the rotating shaft 51 extends in a vertical direction, the rotating shaft 51 is supported by the housing 55 that is secured to the frame 30. Therefore, the top surface of the base portion 41 (support plate 41*b*) of the support base 40 that is supported by the rotating shaft 51 is parallel to a horizontal direction; and the let-off shaft 43, serving as an engaging roller, that is supported parallel to the top surface of the base portion 41 by the support base 40 is such that its axis extends horizontally.

The relationship between the position of the rotating shaft 51 and the position of the support base 40 is such that, in the front-back direction, the axis of the let-off shaft 43 that is supported by the support base 40 is positioned on an extension line of an axis of the rotating shaft 51. In the widthwise direction, while the prepreg roll R is provided at the support base 40 (let-off shaft 43), the center of the prepreg roll R is positioned on the extension line of the axis of the rotating shaft 51. Therefore, the support base 40 is supported by the rotating shaft 51 so that the prepreg roll R that is supported by the support base 40 rotates around the center in the front-back direction and the widthwise direction (rotation center).

In the rotary drive mechanism 50 including the rotating shaft 51, when the clamping mechanism 56 is set in an inoperative state, and the driving motor 57 is driven, the rotation of the output shaft 57*a* is transmitted to the worm wheel 53 via the worm 54. This causes the rotating shaft 51 to rotate. In accordance with the amount of rotation of the output shaft 57*a* resulting from driving the driving motor 57, the speed reduction ratio of the gear train 58, and the speed reduction ratio between the worm 54 and the worm wheel 53, the rotating shaft 51 is rotationally driven, and the support base 40 (support plate 41*b*), connected to the rotating shaft 51, is rotationally driven. After rotationally driving the support base 40 (support plate 41*b*), the clamping mechanism 56 is set again in an operative state, and the rotating shaft 51 is held in an unrotatable state, so that the support base 40 is held in an unrotatable state.

As mentioned above, the support base 40 is supported by the frame 30 via the rotating shaft 51 and the housing 55 of the rotary drive mechanism 50 so as to be capable of being rotationally displaced. In addition, the support base 40 supports the let-off shaft 43 serving as a support shaft. Further, when the support base 40 is rotationally displaced, the let-off shaft 43 rotates. Here, when the support base 40 is rotatable, the let-off shaft 43 is rotatable; and, when the let-off shaft 43 is rotatable, the let-off shaft 43 is tiltable with respect to the prepreg roll R (which the let-off shaft 43 indirectly engages via the winding shaft R1; and in detail, which corresponds to the prepreg sheet S1 that is in a rolled state for forming the prepreg roll R) in a direction that crosses the sheet surface of the prepreg roll R.

Therefore, in the embodiment, the let-off shaft 43 (support shaft) corresponds to an "engaging roller" in the present invention, and the sheet material S1 in the prepreg roll R corresponds to a "sheet material that engages the engaging roller". In addition, the portion including, for example, the support base 40 that supports the let-off shaft 43 (serving as the engaging roller) and the rotating shaft 51 of the rotary drive mechanism 50 for making the support base 40 rotatable corresponds to a "supporting mechanism" in the present invention. However, in the embodiment, the housing 55 of the rotary drive mechanism 50 that is fixedly provided at the base 31 of the frame 30 corresponds to a portion of the frame 30.

The rotating shaft 51 of the rotary drive mechanism 50 to which the support base 40 is secured is rotationally driven by the driving motor 57 (rotary electric motor) at the rotary drive mechanism 50. Therefore, in the embodiment, the driving motor 57 corresponds to an "actuator" in the present invention.

The guide roller 61 upon which the prepreg sheet S1 is wound, the pair of tension detection levers 34 that support the guide roller 61 at the corresponding ends thereof, and the pair of load cells 62 and 62 that are connected to the corresponding end portions of the guide roller 61 via the tension detection levers 34 correspond to what "portions (mechanical structural elements) of the tension detection device 60".

Figure 6:
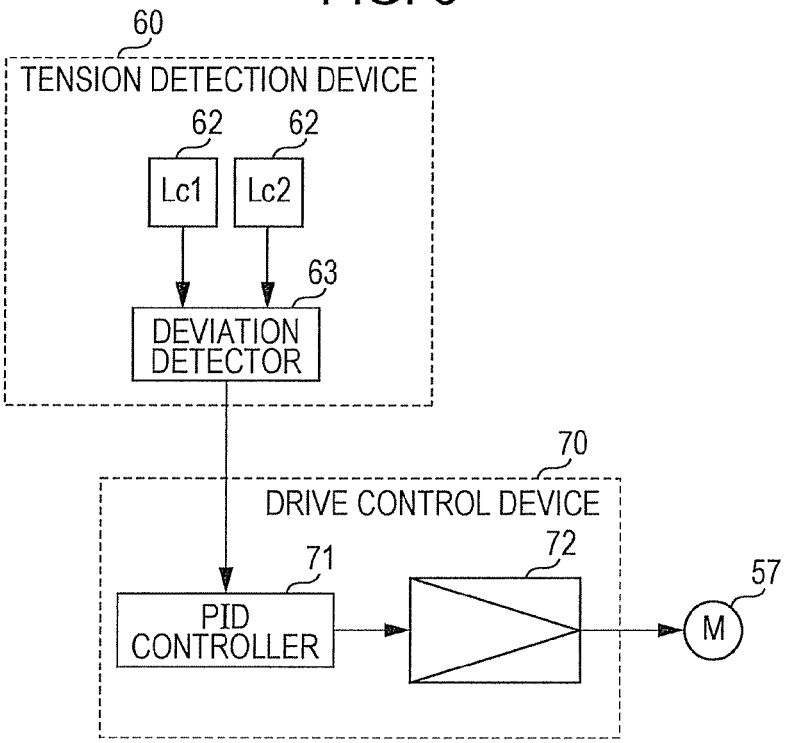
FIG. 6 is a block diagram showing the relationship between a drive control device and a tension detection device that controls tension of a sheet material in the supplying device.

The sheet material supplying section 3 serving as a supplying device according to the present invention includes a drive control device 70 for controlling the driving of the driving motor 57. FIG. 6 shows an example of the drive control device 70. FIG. 6 shows a portion of the tension detection device 60 in addition to the drive control device 70. For the portions of the tension detection device 60, the pair of load cells 62 and 62, serving as mechanical structural elements, are shown together.

In the embodiment, the tension detection device 60 detects, in addition to the tensions at the corresponding end portions of the prepreg sheet S1 in the widthwise direction thereof, the difference between the detected tensions at the corresponding end portions (tension difference). Therefore, as a structure for detecting the tension difference, the tension detection device 60 includes a deviation detector 63 that detects the tension difference as a deviation on the basis of signals from the load cells 62 and 62 (Lc1 and Lc2 in FIG. 6). Therefore, in the embodiment, what is called a "tension detection device" in the present invention includes the deviation detector 63, serving as an electric structural element, in addition to the load cells 62, the tension detection levers 34, and the guide roller 61 serving as the aforementioned mechanical structural elements.

The drive control device 70 controls the driving of the driving motor 57 on the basis of the tension difference detected by the aforementioned tension detection device 60. More specifically, the drive control device 70 includes a PID controller 71 and a driver 72 serving as a drive controller. The PID controller 71 performs PID operation on the basis of a deviation signal (for the tension difference) from the deviation detector 63 of the tension detection device 60, to determine a correction rotation amount of the driving motor 57 that eliminates the deviation, that is, causes the tension difference to become zero. Then, the PID controller 71 outputs the determined correction rotation amount to the driver 72.

Although the deviation detector 63 of the tension detection device 60 detects the tension difference (deviation) on the basis of the detection signals from both load cells 62 and 62 (Lc1, Lc2), the deviation detector 63 determines the deviation with reference to the detection signal from one of the load cells 62. Therefore, the deviation is determined as a positive deviation or a negative deviation in accordance with the magnitudes of the detection signals from the load cells 62 and 62 (Lc1, Lc2). Consequently, the deviation signal that is output from the deviation detector 63 to the PID controller 71 of the drive control device 70 includes the deviation amount (tension difference) and the direction (either a positive direction or a negative direction) of the deviation.

On the basis of the deviation signal including such a deviation direction and a deviation amount, the PID controller 71 performs the PID operation to determine the correction rotation amount in a rotation direction that is in accordance with the deviation direction so as to eliminate the deviation (that is, to cause the deviation to become zero). Then, the PID controller 71 outputs a drive signal that is in accordance with the correction rotation amount towards the driver 72. The driver 72 is an amplifying circuit that causes the driving motor 57 to rotate in accordance with the drive signal. If the drive signal from the PID controller 71 is a positive signal, the driving motor 57 undergoes forward rotation by a predetermined amount, whereas, if the drive signal from the PID controller 71 is negative, the driving motor 57 undergoes reverse rotation by a predetermined amount.

The operation of the structure in the sheet supplying section 3 described above is described in detail below.

First, when the let-off shaft 43 that supports the prepreg roll R in such a manner that the prepreg roll R is incapable of rotating relative to the let-off shaft 43 is driven, the prepreg sheet S1 is positively let off at a predetermined speed from the prepreg roll R. Slitted prepreg sheets (divided sheet S2) are taken up (pulled) by the take-up section 20 of the sheet processing section 2 so that the take-up tension becomes a desired take-up tension. As a result, with a predetermined tension (overall tension) being maintained, the prepreg sheet S1 is placed upon the guide roller 61 of the sheet supplying section 3, and is guided. Therefore, a load that is generated by the tension of the prepreg sheet S1 acts upon the guide roller 61.

However, as discussed in the related art section, there may be a difference between internal stresses (residual stresses) in a portion of the prepreg sheet S1 that is wound into the prepreg roll R (raw-cloth roll) in the widthwise direction. When such a portion is drawn out, the tension difference exists in such a portion in the widthwise direction.

In the sheet supplying section 3, since the load cells 62 are connected to the corresponding end portions of the guide roller 61, when such a tension difference exists in the prepreg sheet S1 in the widthwise direction thereof as mentioned above, the detection values of the load cells 62 (that is, the loads acting upon the load cells 62) differ in accordance with the tension difference.

With reference to the detection value of one of the load cells 62, the deviation detector 63 of the tension detection device 60 determines the deviation between the detection values of the load cells 62 and 62 on the basis of the detection signals from the corresponding load cells 62 and 62 (Lc1, Lc2). In this case, if a tension difference does not exist in the prepreg sheet S1 in the widthwise direction thereof, the deviation is zero, so that the level of the deviation signal that is output from the deviation detector 63 is zero. In contrast, if the aforementioned tension difference exists in the prepreg sheet S1 in the widthwise direction as mentioned above, this tension difference gives rise to a difference between the detection values of the corresponding load cells 62, as a result of which the level of the deviation signal that is output from the deviation detector 63 is in accordance with the difference between the detection values (tension difference).

In the drive control device 70, the PID controller 71 performs PID operation with every predetermined correction period on the basis of the deviation signal from the deviation detector 63. Then, the PID controller 71 outputs the drive signal that has been obtained on the basis of the operation result towards the driver 72. The driver 72 drives the driving motor 57 on the basis of the drive signal.

When the driving motor 57 (output shaft 57*a*) is rotationally driven by the drive control device 70 by the rotation amount and in the rotation direction that are in accordance with the deviation amount and the deviation direction that are based upon the tension difference, the support base 40 that supports the prepreg roll R rotates around the axis of the rotating shaft 51 of the rotary drive mechanism 50 in accordance with the rotation direction and the rotation amount.

The let-off shaft (support shaft) 43, serving as an engaging roller, is supported on the support base 40 (which is supported at the rotating shaft 51 of the rotary drive mechanism 50) while the axis of the let-off shaft 43 extends horizontally. Moreover, the axis of the let-off shaft 43 is positioned on an extension line (vertical line) of the axis of the rotating shaft 51. Therefore, the support base 40 is supported by the frame 30 so as to be rotatable around a rotation axis extending in a direction that is orthogonal to the axis of the let-off shaft 43. As the support base 40 rotates, the let-off shaft 43 also rotates horizontally around the axis of the rotating shaft 51 (in plan view). On the let-off shaft 43, the prepreg roll R is supported with its center in the widthwise direction thereof being on the extension line of the axis of the rotating shaft 51. Therefore, as the let-off shaft 43 rotates, the prepreg roll R also rotates similarly to the let-off shaft 43.

When the let-off shaft 43 rotates and this causes the prepreg roll R to rotate, if path lengths at both end portions of the prepreg sheet S1 in the widthwise direction are compared, the path length of the prepreg sheet S1 changes in a region extending from where the prepreg sheet S1 is transported away from the prepreg roll R to where the guide roller 61 is provided. More specifically, in the front-back direction, the rotation causes the path length to be long at the end portion at the side from where the prepreg sheet S1 is transported away from the guide roller 61, and the path length to be short at the end portion at the side towards which the prepreg sheet S1 approaches the guide roller 61.

In terms of the entire sheet surface of the prepreg sheet S1, this means that the path length is longer from the center of the sheet surface to the end portion thereof at the side from where the prepreg sheet S1 is transported away from the prepreg roll R in the widthwise direction, and that the path length is longer towards this end portion; and that the path length is shorter from the center of the sheet surface to the end portion at the side towards which the prepreg sheet S1 approaches the guide roller 61, and that the path length is shorter towards this end portion. Since the path length changes, the tension of the prepreg sheet S1 changes due to the change in the path length of the prepreg sheet S1.

Therefore, when the tension detection device 60 detects a tension difference in the widthwise direction in the prepreg sheet S1, the prepreg roll R is rotated so that the end portion at the side where the tension is detected as being high becomes the end portion at the side towards which the prepreg sheet S1 approaches the guide roller 61 (that is, the end portion at the side where the tension is detected as being low becomes the end portion at the side where the prepreg sheet S1 is transported away from the prepreg roll R). This causes the tension difference to be corrected.

Even after the tension difference has been corrected, the prepreg sheet S1 is continuously drawn out from the prepreg roll R. As a result, after the correction of the tension difference, a tension difference may occur again between both ends of the prepreg sheet S1 in the widthwise direction thereof.

For example, when a portion of the prepreg sheet S1 where an internal stress (residual stress) difference exists in the widthwise direction is drawn out from the prepreg roll R, a tension difference exists in the prepreg sheet S1 in the widthwise direction when this portion is drawn out. Therefore, the path length is changed, to correct this tension difference. However, thereafter, when an internal stress (residual stress) difference in the widthwise direction does not exist in a portion that is drawn out from the prepreg roll R, a tension difference may occur due to the changed path length. Internal stress (residual stress) differences in the widthwise direction that occur in different portions in the prepreg sheet S1 that is wound into the prepreg roll R are not always the same in these portions. Therefore, even if a tension difference is corrected once as mentioned above, a tension difference may occur again in the widthwise direction in the prepreg sheet S1 that has been drawn out from the prepreg roll R. In this case, since a tension difference is detected again by the tension detection device 60, correction control such as that described above is performed on the basis of the detection.

The sheet material supplying device according to one embodiment of the present invention is described above. However, the embodiment can be modified as follows.

Although, in the above-described embodiment, the path length is changed by horizontally rotating the let-off shaft 43 (support shaft), serving as an engaging roller, as a result of horizontally rotating the support base 40 by rotating the rotating shaft 51 of the rotary drive mechanism 50, the present invention is not limited thereto. The path length may be changed by rotating the support base 40 (let-off shaft 43) in a direction that differs from the horizontal direction.

Figure 7:
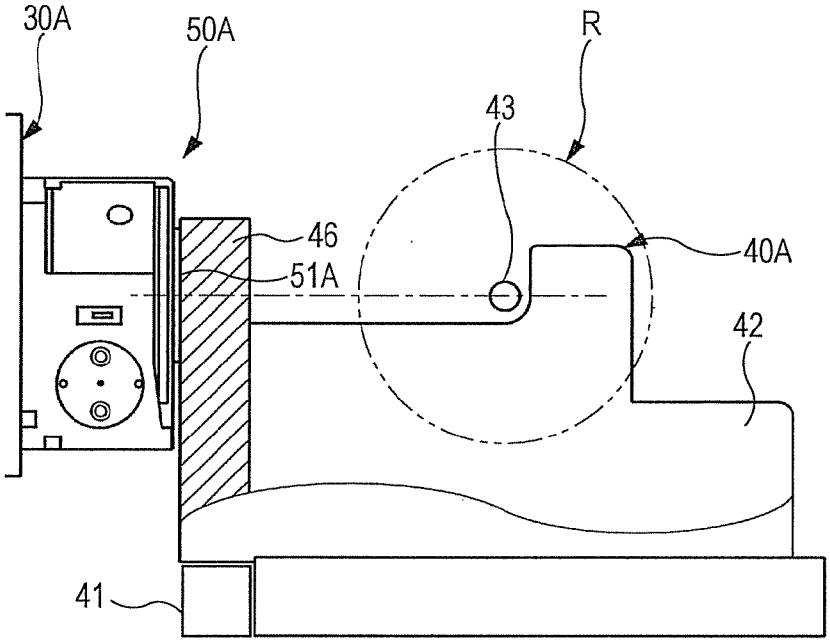
FIG. 7 is a side view of an exemplary supplying device.

For example, as shown in FIG. 7, a support base 40A includes a fixing wall 46 at one end portion of the support base 40A in a front-back direction thereof. The fixing wall 46 extends in a widthwise direction that is orthogonal to a pair of support walls 42 and 42 that support the let-off shaft 43. In addition, for example, as shown in FIG. 7, a rotary drive mechanism 50A having a structure that is the same as that of the rotary drive mechanism 50 according to the embodiment is supported by a frame 30A while the rotary drive mechanism 50A is vertically oriented (that is, while an axis of a rotating shaft 51A is disposed so as to extend horizontally).

In addition to this, the fixing wall 46 of the support base 40A is mounted to the rotating shaft 51A at the rotary drive mechanism 50A, so that the support base 40A is rotatably supported by the frame 30A via the rotary drive mechanism 50A.

The position of the support base 40A with respect to the rotation drive mechanism 50A in this case is such that the axis of the let-off shaft 43 is at the same height as the axis of the rotating shaft 51A, and that an extension line of the axis of the rotating shaft 51A passes through the center of the let-off shaft 43 in the widthwise direction thereof.

According to this structure, as the support base 40A is rotationally displaced by the rotary drive mechanism 50A, the let-off shaft 43 (prepreg roll R) is rotationally displaced around the axis of the rotating shaft 51A as a center in front view. Even this structure provides the same operation and effect as those provided by the embodiment.

When the let-off shaft 43 (support shaft) that supports the prepreg roll (raw-cloth roll) R is an engaging roller, as mentioned above, a "sheet material that engages the engaging roller" in the present invention is the prepreg sheet S1 in the prepreg roll R (prepreg sheet S1 in the form of the prepreg roll R). Therefore, the prepreg sheet S1 exists over the entire periphery of the let-off shaft 43. Consequently, even if the let-off shaft 43 is rotationally displaced in any direction, the axis of the let-off shaft 43 is in a tilted state with respect to the sheet surface of the prepreg sheet S1 prior to the displacement. Thus, when the let-off shaft (support shaft) 43 that supports the prepreg roll (raw-cloth roll) R is an engaging roller, the direction of displacement of the let-off shaft 43 (support base 40) may be in any direction.

Although, in the embodiment, the let-off shaft (support shaft) 43 that supports the prepreg roll R (raw-cloth roll) is an engaging roller, the present invention is not limited thereto. For example, as in the example shown in FIGS. 8A to 8C, it is possible to provide a dedicated engaging roller 91 that engages the prepreg sheet S1 at a location that is downstream of the prepreg roll R, and to displaceably support both end portions of the engaging roller 91 by the frame. This structure is described in more detail below.

Figure 8A:
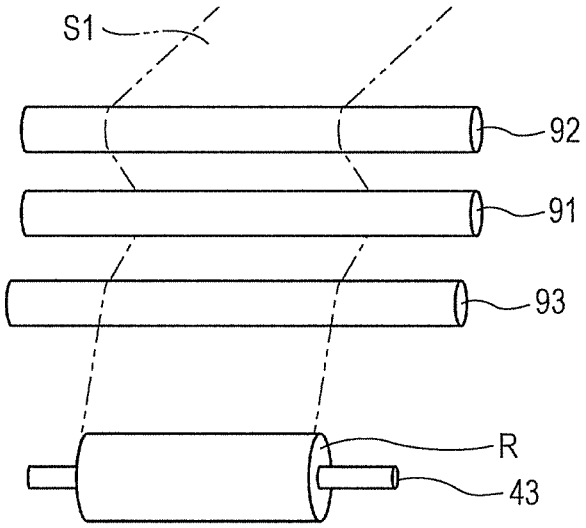
FIGS. 8A to 8C show an exemplary supplying device, with FIG. 8A being a perspective view of a prepreg sheet path, FIG. 8B being a side view of the prepreg sheet path, and FIG. 8C being a perspective view of a rotary drive mechanism.
Figure 8B:
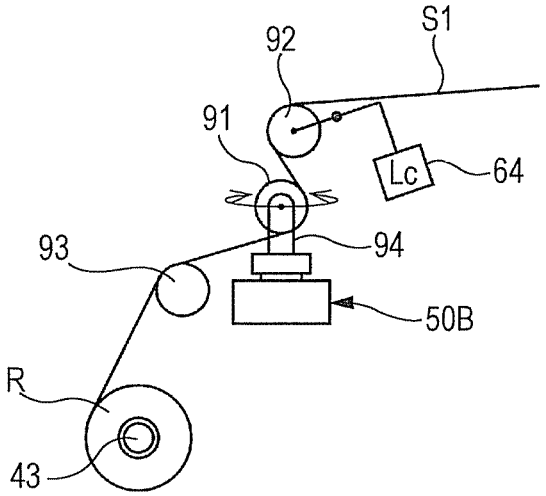

In the structure shown in FIGS. 8A and 8B, a different guide roller 93 is provided upstream of the guide roller 92 (corresponding to the guide roller 61 according to the embodiment) to which a load cell 64 is connected, and the engaging roller 91 that is displaceably supported by the frame (not shown) is provided between the guide rollers 92 and 93.

The engaging roller 91 is supported by a support base 94 at shaft portions 91*a*. The shaft portions 91*a* are provided at corresponding ends of the engaging roller 91. The support base 94 includes a pair of opposing walls 94*a* and 94*a* and a base wall 94*b*, the pair of walls 94*a* and 94*a* opposing each other in a widthwise direction of the engaging roller 91. Therefore, the engaging roller 91 is supported at the shaft portions 91*a* and 91*a* so as to be provided between the pair of opposing walls 94*a* and 94*a* of the support base 94. The support base 94 (base wall 94*b*) is supported by the frame via a rotary drive mechanism 50B. The rotary drive mechanism 50B has the same structure as the rotary drive mechanism 50 according to the embodiment, and is provided while being horizontally oriented (while an axis of the rotating shaft extends vertically). That is, the support base 94 is supported by the frame via a rotating shaft 51B, a bearing, and a housing of the rotary drive mechanism 50B so as to be rotationally displaceable in a horizontal direction. In addition, in this case, a "supporting mechanism" in the present invention includes, for example, the rotating shaft 51B of the rotary drive mechanism 50B and the support base 94.

As shown in FIGS. 8A and 8B, when the prepreg sheet S1 (sheet material) is placed upon the engaging roller 91, and the engaging roller 91 is rotationally displaced by the rotary drive mechanism 50B, the same operation and effect as those provided by the embodiment are provided. In the structure shown in FIGS. 8A and 8B, the guide roller 93 that is provided upstream of the engaging roller 91 may be omitted.

In the above-described embodiment and examples, the rotary drive mechanism 50 (50A, 50B) includes, for example, the driving motor 57 and the worm gear mechanism 59; and the driving motor 57 (output shaft 57*a*) is connected to the rotating shaft 51 (51A, 51B) via the gear train 58 and the worm gear mechanism 59. However, instead, the rotary drive mechanism may be used as a direct drive motor that is directly connected to the rotating shaft 51 and that rotationally drives the rotating shaft 51.

When a dedicated engaging roller is provided as in the example shown in FIGS. 8A to 8C, structures that are described in 1) to 3) below may be used.

1) Although, in the structure shown in FIGS. 8A and 8B, the engaging roller 91 is provided upstream of the guide roller 92 to which the load cell 64 is connected, the engaging roller 91 may engage the prepreg sheet S1 (sheet material) at a location that is downstream of the guide roller 92.

Figure 8C:
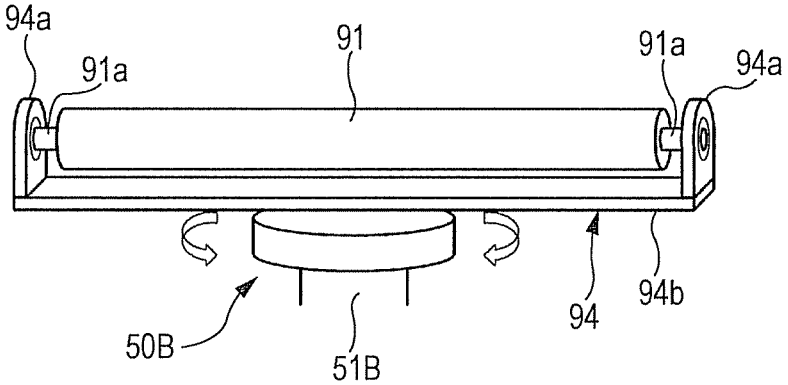

2) In the structure shown in FIGS. 8B and 8C, the engaging roller 91 is supported via the support base 94, and, when the support base 94 is rotationally displaced by an actuator of the rotary drive mechanism 50B, the engaging roller 91 is tilted with respect to the sheet surface prior to the rotation and is rotationally displaced in a direction that crosses the sheet surface. However, instead, it is possible to displaceably support both end portions of the engaging roller by the frame, and displace the end portions of the engaging roller by different actuators. Although such a structure is not illustrated, a more specific structure may be as follows.

For example, a pair of shaft supporting members that are displaceably supported at the frame in a set displacement direction are provided at positions corresponding to the end portions of the engaging roller. As a structure in which the shaft supporting members are made displaceable with respect to the frame, a structure in which guide members, such as slide rails, are fixed to and provided at the frame at corresponding sides of the engaging roller is provided. The guide members extend in a set displacement direction, and guide the displacement of the shaft supporting members. As a structure in which the shaft supporting members are displaced along the guide members, it is possible to use, for example, a ball-screw mechanism to which a rotary electric motor, serving as an actuator, is connected, or a direct driven electric motor (linear motor).

However, in this structure, in order to allow tilting of the engaging roller by displacing the end portions of the engaging roller, it is necessary to form the shaft supporting members so as to allow rotation between a portion of each shaft supporting member that is displaced along the corresponding guide member and a portion of each shaft supporting member to which the corresponding shaft portion of the engaging roller is connected. In addition, as the engaging roller is tilted, the distance between portions of the engaging roller in a horizontal direction (more specifically, the distance in the horizontal direction between ends of the corresponding shaft portions of the engaging roller) changes, as a result of which it is necessary to support the shaft portions of the engaging roller by the shaft supporting members so as to be displaceable in an axial direction thereof.

In controlling each actuator in this structure, instead of performing control on the basis of a tension difference as in the embodiment, it is possible to compare a detection tension value of a corresponding end portion of the prepreg sheet S1

(sheet material) with a reference value, and control the driving of each actuator on the basis of the deviation between the reference value and the detection tension value. In this structure, a combination of the shaft supporting members and the guide members correspond to a "supporting mechanism" in the present invention.

The above-described structure in which both end portions of the engaging roller are displaced by different actuators is also applicable to a case in which the let-off shaft 43 that supports the prepreg roll R according to the embodiment is an engaging roller. In addition, in this case, the support base 40 according to the embodiment is omitted.

3) In the structure shown in FIGS. 8A to 8C, the prepreg sheet S1 (sheet material) is guided while being placed upon the engaging roller. However, as long as both end portions of the engaging roller are displaced by difference actuators as mentioned above, the engaging roller, in its initial state, may be disposed so as to extend in a direction that is orthogonal to the direction in which the prepreg sheet S1 is drawn out, and may be provided simply in contact with the sheet surface, with the axis of the engaging roller being parallel to the sheet surface.

However, in this structure, even if the engaging roller is displaced along the sheet surface of the prepreg sheet S1, that is, even if the engaging roller is displaced so that its axis is displaced in a virtual plane that is parallel to the prepreg sheet S1, a change in the path length of the prepreg sheet S1 does not occur as in, for example, the above-described embodiment. Therefore, obviously, the direction in which the engaging roller is displaced is set so that the end portions of the engaging roller are displaced in a direction that crosses the sheet surface.

In this structure, in the initial state, it is desirable that the engaging roller be displaced by only one of the actuators. This is because, if both actuators are driven on the basis of tension detection results, if one of the actuators displaces an end of the engaging roller towards the sheet surface, the other actuator displaces the other end of the engaging roller in such a manner that the other end of the engaging roller moves away from the sheet surface. As a result, the other end of the engaging roller is separated from the sheet surface, which is not desirable. Therefore, in this structure, it is desirable that the driving of the actuator be controlled so that the actuator is not driven to displace an end portion of the engaging roller towards the side opposite to the sheet surface from the position of the engaging roller in its initial state.

In the embodiment described above, as the processing device to which the sheet material supplying device according to the present invention is applied, the slitter device 1 of the prepreg sheet S1 is given as an example. However, processing devices to which the present invention is applied are not limited thereto. For example, the present invention is also applicable to prepreg sheet lay-up devices such as those disclosed in PTL 2 and PTL 3 that are mentioned in the related art section. The details are as follows.

A lay-up device of a type such as that described in PTL 2 includes a prepreg sheet supplying section (roll stocker) that is provided upstream in a longitudinal direction of a lay-up table for laying up prepreg sheets. In addition, supplying devices are provided in correspondence with a plurality of prepreg rolls in the prepreg sheet supplying section, with each supplying device supporting its corresponding prepreg roll.

The lay-up device in PTL 2 is one in which a plurality of supplying devices are movable in a widthwise direction (that is, in a direction that is orthogonal to the longitudinal direction), a selected supplying device moves to the position of the lay-up table in the widthwise direction, a prepreg sheet is drawn out from the prepreg roll of the selected supplying device, and the prepreg sheet that has been drawn out is placed upon the lay-up table.

In such a lay-up device, it is possible to use a structure "supporting mechanism+rotary drive mechanism, etc." in the supplying device according to the embodiment as each supplying device in the supplying section (roll stocker). The use of such a structure prevents tilting (meandering) of the drawn-out prepreg sheet caused by a tension difference in the widthwise direction.

In the lay-up device in PTL 2, a puller head (puller) holds an end portion (cutting end) of a prepreg sheet of a prepreg roll that is supported by a supplying device, and the puller head is moved to the lay-up table, so that the prepreg sheet is pulled by the puller head, and drawn out from the prepreg roll. Therefore, this puller head corresponds to a "drawing-out mechanism" in the present invention. In addition, the laying up of the prepreg sheets corresponds to "processing" in the present invention.

In this structure, as in the embodiment, tension may be detected by using a guide roller (guide roller 14 in an embodiment in PTL 2) that guides a prepreg sheet so as to change the transport direction thereof immediately after it has been drawn out from the prepreg roll. However, tension may be detected using a puller head.

In a structure that detects tension using a puller head, for example, a gripping head for holding an end portion of a prepreg sheet in the puller head is supported by a body of the puller head while the gripping head is rotatable around a rotation axis in a vertical direction at a center in a widthwise direction thereof. In addition, for example, rotational force of the gripping head with respect to the body of the puller head is supported by a tension detector (load cell) (the body of the puller head and the gripping head are connected via the tension detector (load cell)). In this structure, when a tension difference is occurring in a prepreg sheet in a widthwise direction thereof, as the prepreg sheet is pulled by the puller head, rotational force (load in a rotation direction) acts upon the gripping head due to the tension difference in the widthwise direction. Therefore, when the tension detector detects the rotation force, the tension difference is detected.

Accordingly, tension detection in the present invention is not limited to that carried out using the guide roller and the tension detectors that are connected to the corresponding end portions of the guide roller as it is carried out in, for example, the embodiment.

The lay-up device in PTL 3 that supports a prepreg roll and that travels along a lay-up table lays up prepreg sheets. That is, a self-propelled lay-up device itself supports the prepreg roll in its interior, and a prepreg sheet is drawn out from the lay-up device. In the laying-up operation, while the lay-up device is positioned at one end of the lay-up table in a longitudinal direction thereof, the end portion (cutting end) of the prepreg sheet that has been drawn out from the prepreg roll is held on the lay-up table. In this held state, the lay-up device travels along the lay-up table towards the other end of the prepreg sheet, so that the prepreg sheet is drawn out from the prepreg roll that is supported by the lay-up device, and the prepreg sheet is placed upon another prepreg sheet on the lay-up table.

A prepreg sheet supplying device is built in this self-propelling lay-up device. As a structure of the built-in supplying device, it is possible to use a structure "supporting mechanism+rotary drive mechanism, etc." in the supplying device according to the embodiment. In this practical form, the lay-up device itself functions as a "drawing-out mechanism" in the present invention.

Further, regarding the sheet material supplying device according to the present invention, the sheet material that is to be supplied is not limited to a prepreg sheet such as that described above. For example, other sheet materials, such as a web material or a film, may be used. In other words, the supplying device according to the present invention is applicable to a device that draws out, for example, a web material or a film from a raw-cloth roll and processes it.

The present invention is not limited to, for example, the above-described embodiment. Various changes may be made as appropriate without departing from the gist of the present invention.

What is claimed is:

1. A sheet material supplying device for use with a processing device that draws out a long sheet material from a raw-cloth roll, formed by winding the sheet material into a roll, by a drawing-out mechanism, and that processes the sheet material at a processing section, the sheet material supplying device rotatably supporting the raw-cloth roll with respect to a frame, the sheet material supplying device comprising:

a tension detection device that detects tensions at both end portions of the unprocessed sheet material in a widthwise direction of the sheet material;

an engaging roller located upstream of the processing section in a path of the sheet material that is drawn out from the raw-cloth roll in an upstream side towards the processing section in a downstream side, the engaging roller engaging at least a portion of the sheet material;

a supporting mechanism that supports both end portions of the engaging roller and that is displaceably supported with respect to the frame such that an axis of the engaging roller is tiltable in a direction that crosses a sheet surface of the sheet material with which the engaging roller engages;

an actuator that is connected to the supporting mechanism and that displaces the supporting mechanism; and a drive control device that controls driving of the actuator on the basis of the tensions detected by the tension detection device.

2. The sheet material supplying device according to claim 1, further comprising a guide roller that guides the sheet material so as to change a direction of the path for guiding the sheet material that has been drawn out from the raw-cloth roll towards the processing section, wherein the engaging roller engages the sheet material at a location that is upstream of the guide roller.

3. The sheet material supplying device according to claim 1, wherein the engaging roller is a support shaft that supports the raw-cloth roll with respect to the frame.

4. The sheet material supplying device according to claim 3, wherein the supporting mechanism includes a support base that supports both of the end portions of the support shaft and that is supported with respect to the frame so as to be rotatable around a rotation axis extending in a direction that is orthogonal to the axis of the support shaft, wherein the actuator is a rotary electric motor that is connected to the support base for rotationally driving the support base around the rotation axis, and wherein the drive control device controls a rotation amount of the electric motor on the basis of a difference between the tensions at both of the end portions of the sheet material in the widthwise direction thereof, the tension difference being detected by the tension detection device.

* * * * *